United States Patent [19]

Ryan

[11] 4,374,576

[45] Feb. 22, 1983

[54] SEMI-AUTOMATIC ROLL WINDING MACHINE

[75] Inventor: Ralph L. Ryan, East Hanover, N.J.

[73] Assignee: Compensating Tension Controls, Inc., West Caldwell, N.J.

[21] Appl. No.: 230,634

[22] Filed: Feb. 2, 1981

[51] Int. Cl.[3] ..... B65H 19/16; B65H 19/08

[52] U.S. Cl. ..... 242/58.4; 156/504

[58] Field of Search ..... 242/58.4, 58.5, 58.1, 242/58.2, 58.3; 156/502, 504, 505

[56] References Cited

U.S. PATENT DOCUMENTS

| | | | |
|---|---|---|---|
| 3,645,463 | 2/1972 | Helm | 242/58.1 |
| 3,813,053 | 5/1979 | Butler | 242/58.4 |
| 3,886,031 | 5/1975 | Taitel | 156/504 |
| 3,930,620 | 1/1976 | Taitel | 242/56 A |
| 3,939,032 | 2/1976 | Taitel et al. | 156/505 |
| 4,157,934 | 6/1979 | Ryan et al. | 156/504 |
| 4,233,104 | 11/1980 | Fujishima | 156/504 |
| 4,262,855 | 4/1981 | Haag | 156/504 |

*Primary Examiner*—Edward J. McCarthy
*Attorney, Agent, or Firm*—Arthur L. Frederick

[57] ABSTRACT

The roll winding machine for alternately forming a web roll on two driven arbors. It has a splicing device for receiving a continuously running web from a web accumulator. The splicing device has a splicing carriage for receiving and holding the distal end portion of a leader web and including cutting means for severing the running web so that a severed end portion is provided on the wound web roll and on the continuously running web. A web clamping means is provided to grip and prevent movement of the running web and to release both the severed end portion of the web of the wound roll and the running web. The splicing carriage is operative to cut the running web and affix the severed end portion of the running web to the distal end portion of the leader web so that the running web is wound on the other driven arbor upon movement of the clamping means to release the running web and leader web.

7 Claims, 5 Drawing Figures

SEMI-AUTOMATIC ROLL WINDING MACHINE

This invention relates to roll winding machines and, more particularly, to a roll winding machine capable of receiving a continously running web and to wind such web alternately on different cores without interruption of the running of the web.

BACKGROUND OF THE INVENTION

Heretofore, fully automatic roll winding mechanisms, sometimes known as rewinders and as exemplified in the U.S. Pat. No. 3,930,620, to Taitel, are relatively expensive and have certain operational limitations. One such limitations of rewinders having more than two core supporting spindles is that the maximum diametral size of the roller is restricted by the space between the stations on the turntable or turret which is, in turn, limited by the maximum practical diameter of the turret. Another limitation is that the time for achieving adhesion of the web to the core is limited and, therefore, for webs of coarse woven material insufficient time is available to effect attachment of the web to a new core. Similarly, attachment of webs of a material having a low coefficient of friction, as for example, a film of polytetrafluoroethylene, to new cores are not readily achieved automatically. Also, in connection with the transfer of the running web of coarse woven or low coefficient of friction material from a completed roll to a new core, the aforesaid automatic turret type rewinders, because of the time restrictions imposed by indexing from one station to another, have the further limitation of the size splicing adhesive tape which can be employed to attach the severed web to the web leader and, thus, are not readily capable of effecting the transfer and winding of rolls of coarse or low coefficient friction material. A still further limitation is that the attachment of a web of relatively stiff or inflexible material is not readily achievable automatically on the relatively small diameter cores employed in some currently known turret rewinders. The aforesaid limitations are eliminated by the semi-automatic roll winding machine of this invention.

It has also been found that existing splicing devices, as for example the types exemplified in the U.S. patents to Taitel et al. No. 3,939,032 and Ryan et al. No. 4,157,934, are not suitable for roll winding machines, therein rolls are wound from a source of continuously running or feeding web without interruption of such web feed, because clamping and cutting of the web on the feeding side of the clamp leaves the web with a free end out of control. Accordingly, the present invention provides a roll winding machine having a splicing device in which the web is clamped so that the feeding web end portion remains clamped after the web is cut and until the splice is completed.

It is, therefore, an object of this invention to provide a roll winding machine capable of receiving a continuously feeding web and to transfer the web from a completed roll to a new roll core without interruption of the web feed.

Another object of the present invention is to provide a roll winding machine which is capable of effecting the transfer of webs of a wide variety of types and material from a completely wound roll to a new roll core without interruption of web feed.

A still further object of this invention is to provide a roll winding machine which is capable of use with a wide range of web feeding speeds.

Another object of the present invention is to provide a roll winding machine which is capable of winding web rolls of larger size, as well as being simpler and less expensive, than heretofore known turret rewinders.

SUMMARY OF THE INVENTION

Accordingly, the present invention contemplates a novel roll winding machine for receiving from another or parent machine a continuously feeding web and capable of transferring the web from a completed roll to an empty core for winding another roll without interruption of the continuous web feed. The roll winding machine comprises a support means and a web accumulator supported by the support means for receiving the web being fed by the parent machine. The roll winding machine also includes a splicing device for receiving the web from the accumulator. A first driven arbor is supported for rotation by the support means and carries a core upon which the web running from the splicing device is being rolled to form a web roll. A second driven arbor is supported for rotation by the support means and carries a second core having affixed thereto one end of a leader web. A motor means is provided for alternately rotatively driving said first and second arbors at speeds selected in relation to the speed of the running web to maintain a desired tension on the web and prevent slacking, tearing or stretching of the web. The splicing device has means for receiving and holding the distal end portion of the leader web from said second core. The splicing device also has a clamping means and a splicing carriage means which includes a leader web holding means. The clamping means is operative in one position to grip and prevent movement of the running web and in another position to release both the severed end portion of the running web and the running web. The splicing carriage means is operative for cutting the running web and affixing the running end portion of the severed web to the distal end portion of the leader web so that the running web is wound on the second core upon movement of the clamping means to a position releasing the running web.

The roll winding machine of this invention is capable of winding web rolls of relatively large diameter size in relation to overall size of the machine. In addition, since the leader web is manually attached to the empty core and positioned in the splicing device, there is virtually no limitation on the size of the splicing adhesive tape which can be utilized to effect attachment of the severed web and web leader and, therefore, a wider range of types and kinds of web material can be splined and thus be formed into web rolls from a continuously running web without interruption of the continuous web feed than is capable by heretofore known automatic roll winding machines.

BRIEF DESCRIPTION OF THE DRAWINGS

The invention will be more fully understood from the following detailed description thereof when considered in connection with the accompanying drawings wherein but one embodiment of the invention is illustrated by way of example and in which.

DESCRIPTION OF THE PREFERRED EMBODIMENT

Figure 1:
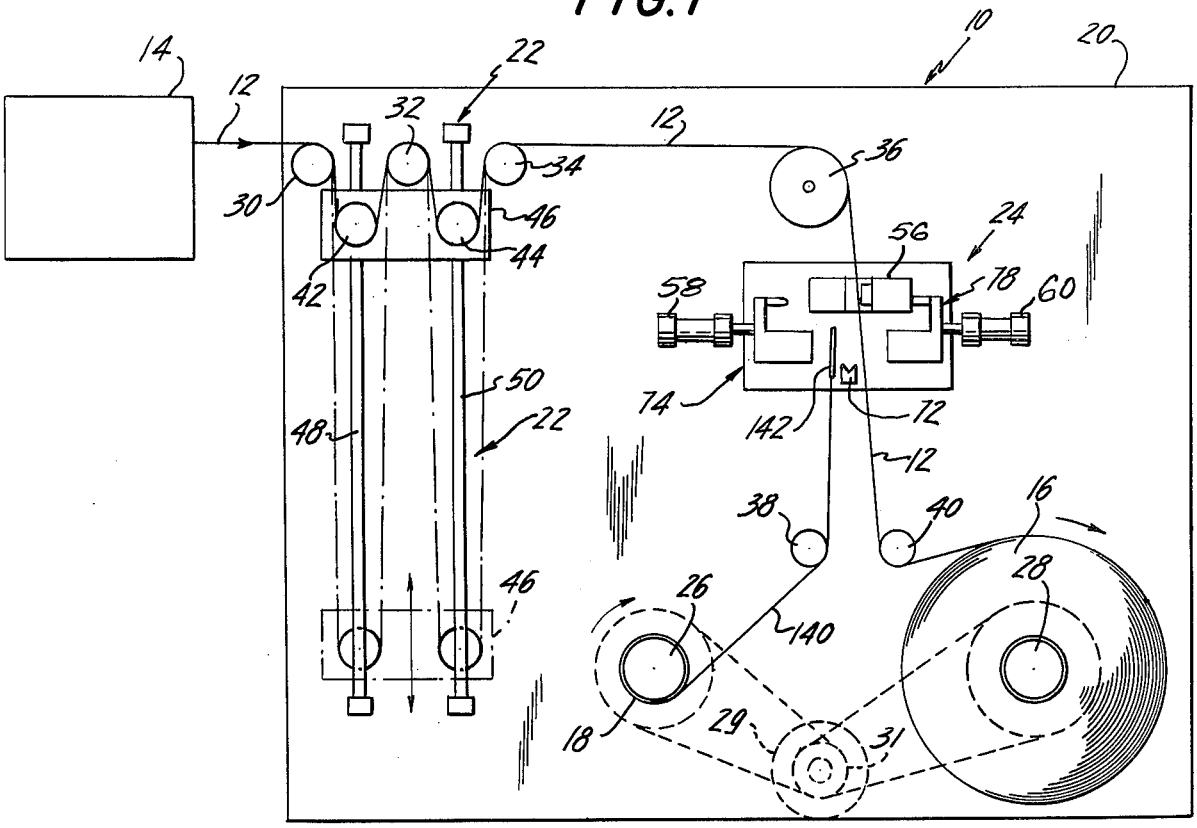
FIG. 1 is a schematic drawing of the roll winding machine according to this invention.

Now referring to the drawings and more specifically to FIG. 1, the reference number 10 generally designates the roll winding machine according to this invention, which machine is capable of receiving a continuously running web 12 from a parent or associated machine 14, such as a printing press, and transferring such running web, from a wound roll 16, to an empty core 18 for winding another roll without interruption of the continuously running web feeding from apparatus 14. The roll winding machine 10 comprises a support structure 20 on which are mounted a storage festoon carriage or an accumulator 22, a splicing device 24 and at least two spaced spindles or arbors 26 and 28 for receiving roll cores on which the web is to be wound. The arbors 26 and 28 are rotatively driven by any suitable source of rotary power, such as an electric motor 29, and through an electrically controlled clutch 31 of any suitable type so that the arbors can be selectively and independently rotated from the motor 31. The accumulator 22, splicing device 24 and the arbors 26 or 28 are arranged relative to each other so as to serially receive web 12. The web is successively woven around stationary rollers 30, 32 and 34, which form part of accumulator 22, and idler rollers 36, 38 and 40. The idler rollers are also supported by support structure 20. The roller 34 may be a counter roller which monitors the amount of web 12 passing over the roller.

The accumulator 22 comprises, in addition to linearly stationary idler rollers 30, 32 and 34, two movable rollers 42 and 44 which are mounted on a slide 46. The slide 46 is supported for vertical movement by two spaced, parallel guide rods 48 and 50. The accumulator functions, upon downward movement on rods 48 and 50 toward the broken line position shown in FIG. 1, to take-up the surplus amount of web 12 which would otherwise occur when the running of web 12 is stopped at the splicing device 24 as will be hereinafter more fully described. The accmulator 22 may be of any suitable type capable of providing storage of the web during interruption of the running of web 12 and the transfer of the web 12 to a roll leader and thereby maintenance of a substantially uniform tension of the web. A typical accumulator or storage festoon and tensioning controlling system is fully disclosed in the U.S. Pat. No. 3,886,031, to Taitel but is functionally reversed from that required in the roll winding machine of this invention, in that the direction of web feed is away from a machine rather than toward a using machine.

Figure 2:
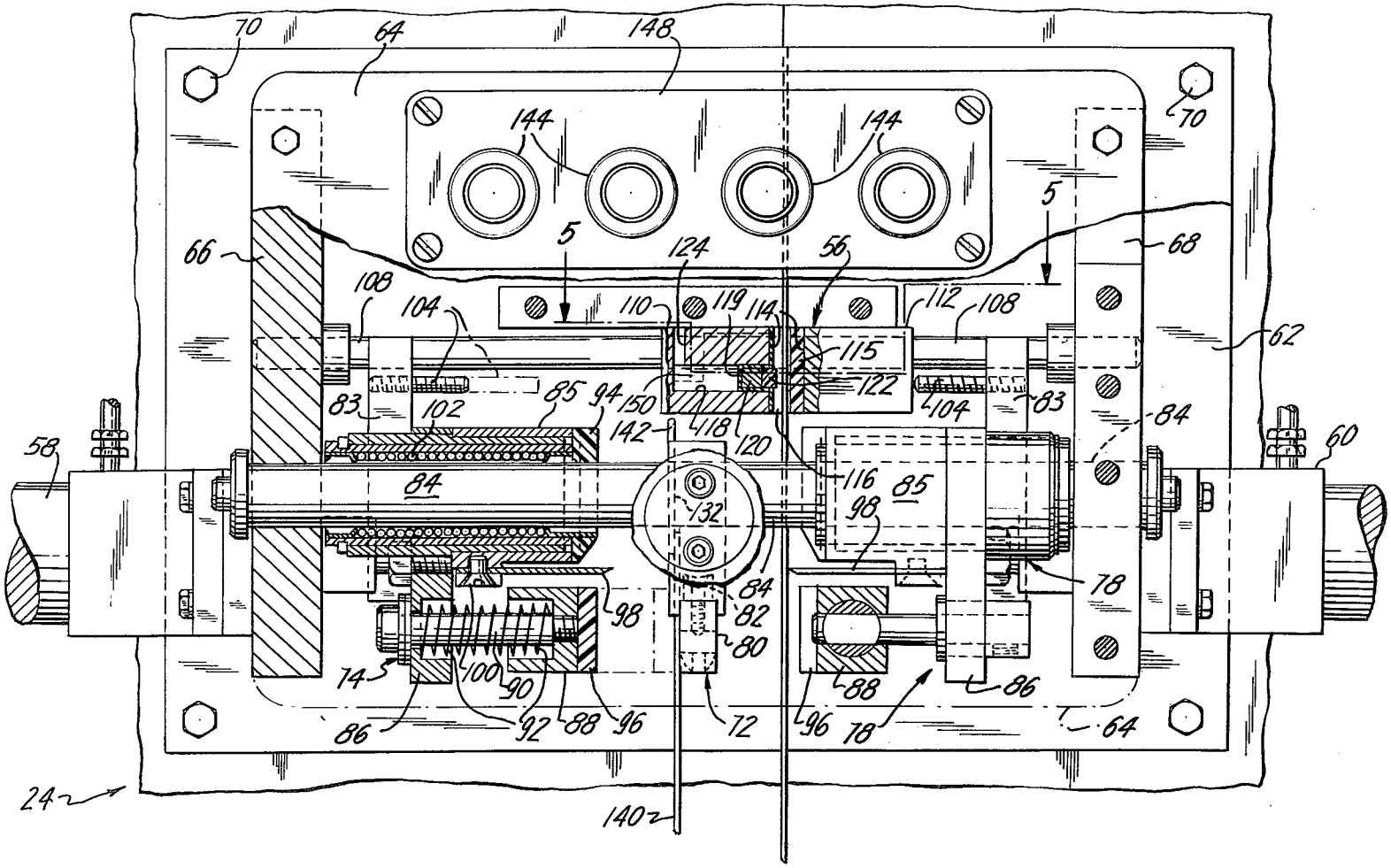
FIG. 2 is an end elevational view of the splicing device shown schematically in FIG. 1 and which comprises part of the roll winding machine shown in FIG. 1, parts being broken away for illustration purposes only.
Figure 3:
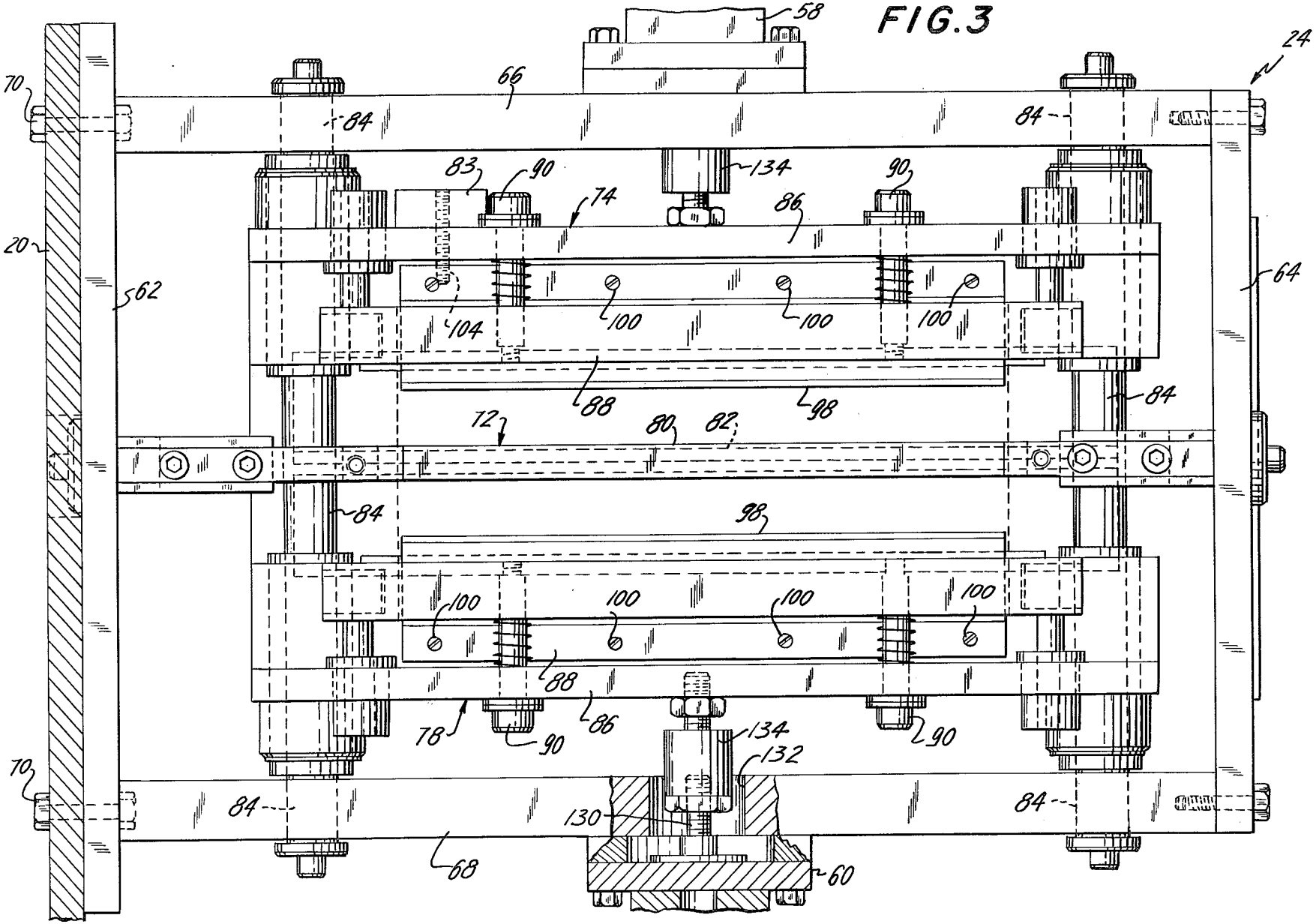
FIG. 3 is bottom plan view in elevation of the splicing device shown in FIG. 2, with parts broken away for illustration purposes.
Figure 4:
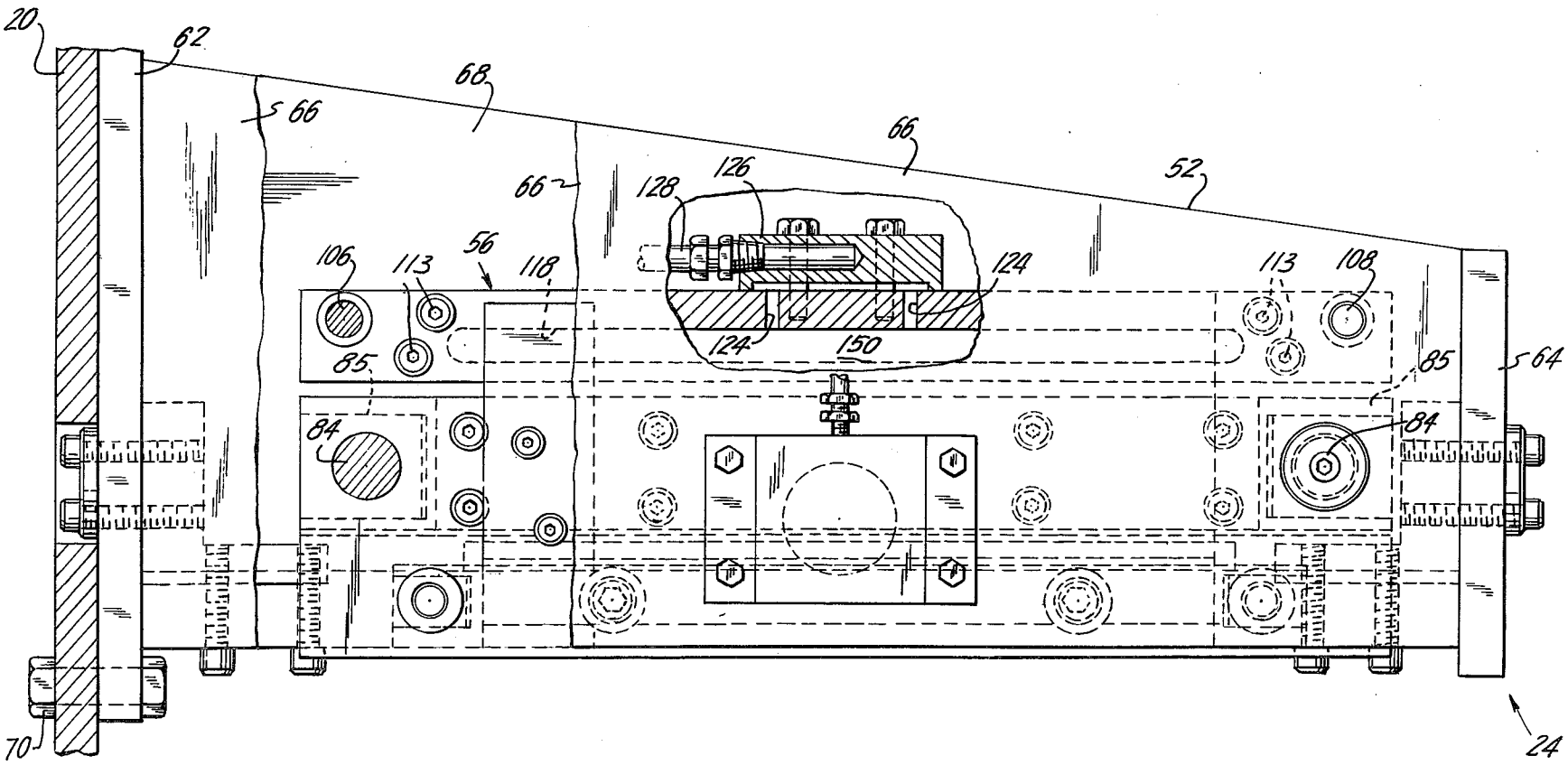
FIG. 4 is a side elevational view of the splicing device of FIGS. 2 and 3 with parts broken away for illustration purposes.

As best shown in FIGS. 2 to 4 splicing device 24 comprises, in general, a frame 52 within which is supported for reciprocative movement, a splicing carriage means consisting of a pair of splicing carriages 74 and 78 and a web clamp assembly 56, similar to that disclosed in the U.S. Pat. No. 4,157,934 to Ryan, except for web clamp assembly 56. Two rectilinear, piston-cylinder motors 58 and 60 of hydraulic or pneumatic type are mounted in juxtaposition to each other on frame 52 and are connected to the splicing carriages 74 and 78 to effect independent movement of the splicing carriages relative to stationary knife assembly 72.

The frame 52 consists of a rear mounting wall 62, a front wall 64 and two spaced, parallel side wall 66 and 68 which are connected in any suitable manner, as for example by bolting, at their opposite ends to rear and front walls 66 and 68. The entire frame 52 is secured to support structure 20 by mounting bolts 70.

The stationary knife assembly 72 comprises an elongated bar 80 rigidly secured at its opposite ends to rear wall 62 and front wall 64 so as to extend midway between and parallel to side walls 66 and 68. A blade 82 is secured to bar 80. The splicing carriages 74 and 78 are supported for reciprocative movement relative to stationary knife assembly 72 on spaced parallel shafts 84. The shafts 84 are supported by and secured at their opposite ends to side walls 66 and 68.

Each of the splicing carriages 74 and 78 consists of a generally elongated body portion 85, rectangular in cross section, to which are secured plates 83 and 86 lying coextensive with the length of body portion 85. A clamping bar 88 is mounted on plate 86 in spaced substantial parallelism to plate 86 by a pair of studs 90. A spring 92 surrounds each of the studs 90 to bias clamping bar 88 away from plate 86 and to allow resilient, relative movement between the clamping bar 88 and body portion 85. Both body portion 85 and clamping bar 88 have resilient pressure pads 94 and 96, respectively. Also secured to and carried by body portion 85 is a blade 98 which is secured to the body portion by a plurality of screws 100. The blade 98 is so positioned relative of stationary blade 82 that it passes in very close spaced relationship to blade 82 and coacts therewith to cut the web 12 which lies in a plane therebetween. To facilitate slidable movement of body portion 85 on shafts 84, each of the shafts pass through a bushing 102 which is disposed in a hole in body portion 85. Preferably, the bushings 102 are of a type to minimize frictional resistance, as for example a ball-type bushing illustrated in FIG. 2. A plurality of pins 104 are secured in plate 83 to engage web clamp assembly 56 and effect movement of the latter as will be more fully explained hereinafter.

Figure 5:
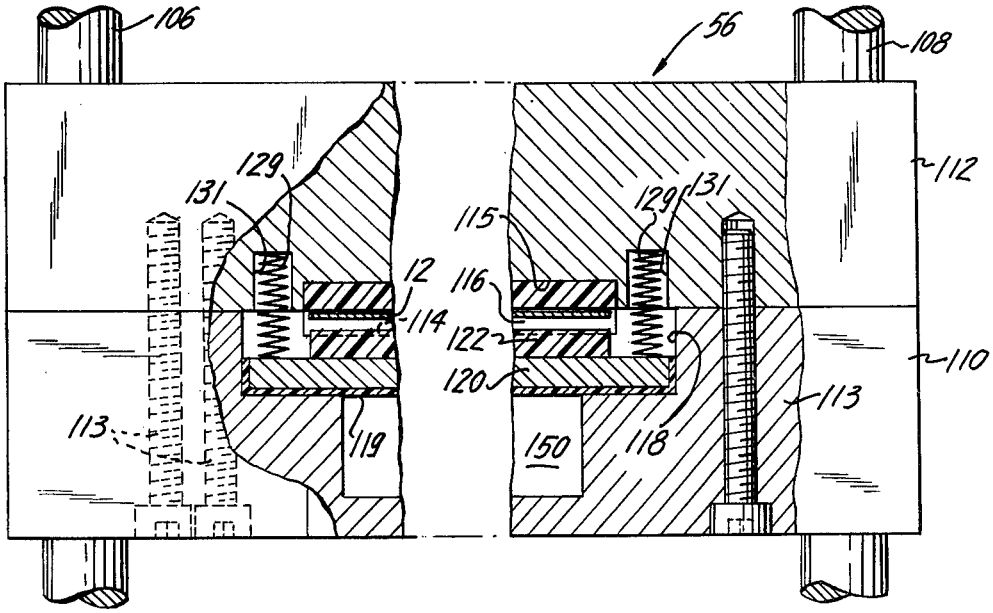
FIG. 5 is a fragmentary cross sectional view taken substantially along line 5—5 of FIG. 2, somewhat enlarged and turned 90°, counterclockwise.

The web clamp assembly 56 is disposed adjacent to and above splicing carriages 74 and 78, as viewed in FIGS. 2 and 4. The web clamp assembly 56 is supported and guided in reciprocable movement by a pair of spaced, parallel rods 106 and 108 which are anchored at opposite ends in sidewalls 66 and 68. As best shown in FIG. 5, web clamping assembly 56 consists of two elongated, substantially rectangular shaped bars 110 and 112 secured together by bolts 113 (see FIG. 4). As best shown in FIGS. 2 and 5, each of the bars 110 and 112 has a recessed middle portion 114 in juxtaposed abutting surfaces. The recessed portion 114 of the bar 112 has a resilient pad 115 therein. The recess 114 of bar 110 defines with pad 115 an elongated slot 116 through which the running web 12 travels. The bar 110 has in the bottom wall of its recess 114 a stepped elongated groove 118 in which is slidably disposed a nip bar 120. The nip bar 120 has a resilient pad 122 secured to the outer surface of the nip bar. To effect actuation of nip bar 120, pressurized fluid, as for example air, is passed into the chamber formed between nip bar 120 and the bottom of groove 118 by way of inlets 124. The inlets 124 communicate with a pressurized-fluid connector 126 which is secured to bar 110 (see FIG. 4), the connector 126 being connected to a source of pressurized fluid (not shown), via pipe 128. The nip bar 120 functions, when forced by pressurized fluid to the right, as viewed in FIG. 2 and upwardly as viewed in FIG. 5, against the biasing force of two springs 129 seated in blind bores 131, to clamp the feeding or running web 12 against the resilient pad 115 in bar 112 during the cutting and transfer phase of operation of the roll winding machine 10. To seal the interstices between nip bar 120 and the walls of groove 118, a resilient boot 119 is seated in groove 118 so as to embrace the nip bar.

The piston-cylinder fluid motors 58 and 60 are each connected to body portion 85 of the splicing carriages 74 and 78 with which it is associated. As best shown in FIG. 3, fluid motor 60 is connected to body portion 85 of splicing carriage 78 by a piston rod 130 which extends through an opening 132 in side wall 68. The piston rod 130 is connected at one end to the piston (not shown) of fluid motor 60 to move linearly with the piston and, at the other end, is connected to body portion 85 via an aligner-coupling 134.

To provide for semi-automatic operation of roll winding machine 10, a pressurized fluid control system (not shown) of any suitable type, as for example a pneumatic system employing solenoid valves disclosed in the U.S. Pat. No. 4,157,934, to Ryan et al., is provided. Such a system would also include the counter roller 34 which measures the amount of web 12 which has passed and thereby senses the size of the roll being wound and, when the roll is full, generates an electrical signal which is conducted to a solenoid controlled valve (not shown) to initiate the transfer or splicing sequence of operation. Such a control system would include a suitable control circuit to control clamping and release of nip bar 120.

The roll winding machine 10 operates in the following manner to effect the transfer of a continuously running web 12 from a full web roll 16 to an empty core 18. First, a web leader 140 is manually attached at one end to an empty core 18, which web leader has at its free end a pressure adhesive tape 142 secured thereto so as to project beyond the end of the leader. The web leader 140 is then led over roller 38 and into splicing device 24 so that it lies against bar 80 of stationary knife assembly 72. The splicing carriage 74 or 78, as for example splicing carriage 74, is moved to the right as viewed in FIGS. 1 and 2 to the dot-dash line position. This action is initiated by actuation of a solenoid switch (not shown) by depressing a button 144 on a control panel 148. This action permits flow of low pressure fluid into fluid motor 58 which pressure is sufficient to move splicing carriage 74 and cause clamping bar 88 to squeeze web leader 140 against the side of stationary knife assembly 72 without compressing springs 92. Here, the web leader 140 is held until transfer is desired. After the counter roller 34 senses that web roll 16 is full, the nip bar 120 is forced to the right, as viewed in FIGS. 1 and 2, by fluid pressure admitted to the chamber 150 which is defined by the nip bar and groove 118, to clamp the running web 12 against pad 115. Since the parent machine 14 continues to feed the web at line speed, the accumulator 22 begins to collect the surplus web 12. Fluid at high pressure is now admitted to fluid motor 60 which drives splicing carriage 78 to the left, as viewed in FIGS. 1 and 2, to thereby carry web 12 to the side of stationary knife assembly 72 opposite from web leader 140 and with further movement cuts the web by the cooperative shearing action of the edge of blade 98 and edge of stationary blade 82. Even though clamping bar 88 of splicing carriage 78 is carried into abutment against stationary knife assembly 72, blade 98 continues to be carried to the left by reason the relative movement allowed between body portion 85 and clamping bar 88 by pins 90 which move away from plate 86 against the force of springs 92. The severed web 12 is carried by the movement of splicing carriage 78 to the left, as viewed in FIGS. 1 and 2, by reason of the abutment of pins 104 against web clamp assembly 56 which is gripping web 12 as previously explained. The severed web 12 is thus carried to the left and is pressed between resilient pads 94 of splicing carriages 74 and 78 against adhesive tape 142 which is attached to leader web 140. The continued movement of splicing carriage 78 to the left, as viewed in FIG. 2, forces splicing carriage 78 to its original position shown in full lines via abutment of web clamp assembly against pins 104 which are carried by splicing carriage 74. The pressurized fluid in chamber 150 of second web clamp assembly 56, which has been maintaining, via nip bar 120, a grip on the web 12, is now vented. With the release of pressure in chamber 150, nip bar 120 is forced by springs 131 (FIG. 5) to the left as viewed in FIG. 2, and thus web 12 is released. The drive of spindle 28 is stopped and the waiting spindle 26 is rotatively driven and, as web 12 is wound on empty-core 18, accumulator 22 returns to its original position shown in full lines in FIG. 1. The full wound roll 16 is removed from spindle 28 and a new core is connected to the spindle 28 and a new web leader is prepared and positioned as previously described but on the opposite side of stationary knife assembly 72. At this time, the running web which is being wound on core 18 is traveling through slot 116 of web clamp assembly 56 on the opposite side of stationary knife assembly 72 from that position shown in FIG. 2, the web clamp assembly 56 having been moved by movement of splicing carriage 78 as previously described. When core 18 is fully wound, transfer or splicing of the web on the new leader web attached to the core on spindle 28 is achieved as previously described, except that the functional rolls of the pair of splicing carriages are reversed.

It is believed now readily apparent that the present invention provides a semi-automatic roll winding machine which is capable of effecting a transfer from one roll core to another from a continuously running web. It is a machine in which web rolls of substantially large size can be wound relative to the overall size of the machine. It is also a machine wherein splicing of difficult to splice web material can be accomplished because the size of the pressure adhesive tape is not limited by time or size of core as is the case with automatic machines.

Although but one embodiment of the invention has been illustrated and described in detail, it is to be expressly understood that the invention is not limited thereto. Various changes can be made in the arrangement of parts without departing from the spirit and scope of the invention as the same will not be understood by those skilled in the art.

What is claimed is:

1. A roll winding machine for receiving a continuously running web from a source thereof and winding the web on a core to from a web roll, the machine comprising (a) support means;

(b) a web accumulator supported means for receiving the continuously running web to be wound from the source thereof;

(c) a splicing device supported by the support means for receiving the web to be wound from the web accumulator;

(d) a first driven arbor supported for rotation by the support means and carrying the core upon which the web running from the splicing device is to be wound to form a first web roll;

(e) a second driven arbor supported for rotation by the support means adjacent the first arbor and carrying a second core having affixed thereto one end of a leader web and upon which a second web roll is to be wound;

(f) motor means for alternately rotatively driving said first and second arbors;

(g) said splicing device having (g-1) a splicing carriage means for receiving and holding the distal end portion of said leader web and including cutting means for severing the running web to be wound so that a severed end portion is provided on the first web roll, and on the running web to be wound into said second web roll;

(g-2) web clamping means operative in one position to grip and prevent movement of the running web and, in another position, to release both the severed end portion of the first web roll and the running web to be wound into said second web roll;

(g-3) said splicing carriage means including the cutting means being operative to cut the running web to be wound after it is wound to the extent predetermined on said first web roll and affix the severed end portion of the running web to be wound into said second web roll to the distal end portion of the leader web so that the running web is capable of being wound on the second core supported on the second arbor upon movement of the clamping means to a position to release the running web and the leader connected to said second core.

2. The machine of claim 1 wherein said web clamping means is mounted for slidable movement normal to the plane of the running web.

3. The machine of claim 1 wherein said splicing means comprises a pair of splicing carriages disposed on opposite sides of the running web and said splicing carriage being alternately movable toward and away from the surfaces of the running web and wherein said clamping means is mounted for slidable movement normal to the plane of the running web.

4. The machine of claim 3 wherein connective means is provided for effecting conjoined slidable movement of the web clamping means alternately with one or the other of said pair of splicing carriages.

5. The machine of claim 4 wherein said web clamping means comprises a movable member and a stationary wall between which the running web extends and wherein said movable member is actuatable toward the stationary wall to clamp said running web against movement and away from the stationary wall to release the running web for movement.

6. The machine of claim 4 wherein said web clamping means comprises a body member and a bore within said body member and wherein said movable member is a piston disposed for slidable movement within said bore.

7. The machine of claim 1 wherein said web clamping means comprices (7-a) a body portion having a slot therein for receiving the running web;

(7-b) a bore in the body portion extending inwardly from said slot;

(7-c) a piston disposed for slidable movement in said bore;

(7-d) said piston and bore defining behind said piston a chamber;

(7-e) means for conducting pressurized fluid into said chamber for forcing said piston in a direction out of said bore and into said slot to clamp the running web against the opposite wall of said slot; and (7-f) biasing means for exerting a force on the piston tending to keep the piston in said slot so that upon venting of said chamber, the piston is moved in a direction into the slot to thereby release said running web.

* * * * *